US005256125A

United States Patent [19]

Jones

[11] Patent Number: 5,256,125

[45] Date of Patent: Oct. 26, 1993

[54] BICEPS CURL MACHINE

[76] Inventor: Arthur A. Jones, 1155 NE 77th St., Ocala, Fla. 32670

[21] Appl. No.: 909,658

[22] Filed: Jul. 7, 1992

Related U.S. Application Data

[60] Continuation-in-part of Ser. No. 813,531, Dec. 26, 1991, Pat. No. 5,149,313, which is a division of Ser. No. 422,905, Oct. 18, 1989, Pat. No. 5,005,830, which is a division of Ser. No. 236,367, Aug. 25, 1988, Pat. No. 4,902,009, which is a continuation-in-part of Ser. No. 60,679, Jun. 11, 1987, Pat. No. 4,836,536, and Ser. No. 181,372, Apr. 14, 1988, Pat. No. 4,834,365.

[51] Int. Cl.[5] ..... A63B 21/00

[52] U.S. Cl. ..... 482/137; 482/98; 482/134

[58] Field of Search ..... 482/94, 97-104, 482/133, 134, 137, 138

[56] References Cited

U.S. PATENT DOCUMENTS

| | | | |
|---|---|---|---|
| 2,135,018 | 11/1938 | Svensson | 482/94 |
| 3,042,023 | 7/1962 | Yates | 482/97 X |
| 3,116,062 | 12/1963 | Zinkin | 482/98 |
| 3,917,262 | 11/1975 | Salkeld | 482/98 |
| 4,149,714 | 4/1979 | Lambert, Jr. | 482/137 X |
| 4,239,210 | 12/1980 | Lambert, Jr. . | |
| 4,462,252 | 7/1984 | Smidt et al. | 482/137 X |
| 4,500,089 | 2/1985 | Jones | 482/100 |
| 4,538,805 | 9/1985 | Parviainen | 482/98 |
| 4,541,628 | 9/1985 | Parviainen | 482/137 |
| 4,563,003 | 1/1986 | Bogallo et al. | 482/100 |
| 4,768,779 | 9/1988 | Oehman, Jr. et al. | 482/134 X |
| 4,790,530 | 12/1988 | Maag . | |
| 4,817,943 | 4/1989 | Pipasik | 482/137 X |
| 4,836,536 | 6/1989 | Jones | 482/134 |
| 4,917,379 | 4/1990 | Maag . | |
| 4,957,281 | 9/1990 | Christolear, Jr. | 482/100 |

FOREIGN PATENT DOCUMENTS

| | | | |
|---|---|---|---|
| 2643822 | 9/1990 | France | 482/97 |
| 279412 | 6/1990 | German Democratic Rep. | 482/97 |

OTHER PUBLICATIONS

Cybex Strength Systems p. 3.

Spring—Hoggan Health Industries Inc.

*Primary Examiner*—Robert Bahr

*Attorney, Agent, or Firm*—William E. Mouzavires

[57] ABSTRACT

A machine for exercising the bicep muscles of the arms includes a movement arm rotatable about a horizontal axis by exertion of the bicep muscles of a user who is in seated position while gripping the handle of the movement arm and pivoting the forearm upwardly about the elbow. The backs of the upper arms rest on a roller pad while the forearms engage a forearm pad that moves along an arc with the movement arm about a horizontal axis to properly position the forearms and prevent forward movement of the user's body during rotation of the movement arm. A compound weight stack provides a yieldable resistance to the movement arm and is connected thereto through a drive lever and linkage positioned below the level of the weight stack.

12 Claims, 7 Drawing Sheets 11
72
86
12
90
46
78
78
70
34
37
33
22
40
50
74
85
32
30
54
56
20
23
63
60
24
27
62
24
25
70
64
14
57
23
66

11
46
34
46
33
35
35
22
31
28
28
36
33
37
29
32
16
42
42
40
44
37
18
20
70
26
12
62
64
14

BICEPS CURL MACHINE

RELATED APPLICATIONS

This application is a continuation-in- part of my pending application Ser. No. 07/813,531, now U.S. Pat. No. 5,149,313 filed Dec. 26, 1991, which is a division of my prior co-pending application Ser. No. 07/422,905, filed Oct. 18, 1989, now U.S. Pat. No. 5,005,830 which in turn is a division of my prior application Ser. No. 07/236,367, filed Aug. 25, 1988, now U.S. Pat. No. 4,902,009, which in turn is a continuation-in-part of my prior United States patent application, Ser. No. 07/060,679, filed Jun. 11, 1987, now U.S. Pat. No. 4,836,536 and Ser. No. 07/181,372, filed Apr. 14, 1988, now U.S. Pat. No. 4,834,365 and entitled "Compound Weight System". The disclosures of my above-identified patent applications are hereby incorporated by reference into the instant application as part hereof.

OBJECTS OF INVENTION

The present invention relates to a machine and method for exercising the biceps of the upper arms of the human body.

One of the objects of the present invention is to provide a novel method and apparatus for exercising the biceps in a safe and efficient manner.

Another object of the present invention is to provide novel method and apparatus for exercising the biceps by rotating a movement arm about a generally horizontal axis while pivoting the arms at the elbow against a resistance and wherein the elbow joint is generally aligned with the axis of rotation of the movement arm.

A further object of the present invention is to provide novel method and apparatus for exercising the biceps while the user is seated in a relatively comfortable position. Included herein is a provision of such a method and apparatus wherein the user rotates a movement arm about a generally horizontal axis by flexing the bicep muscles while restraining the torso against forward movement as the biceps are flexed and the movement arm is rotated.

A further object of the present invention is to provide novel method and apparatus for exercising the biceps against a resistance provided by a weight stack whose weights are moved upwardly from below by means of a drive lever a opposed to conventional overhead pulley and cable systems. Included herein is the provision of such a method and apparatus for exercising the biceps which utilizes a compound weight stack incorporating at least two independently usable weight stacks that allow not only a large selection of different resistance weights but also different resistance weights that may be selected in small increments.

A further object of the present invention is to provide a novel and improved biceps machine incorporating a weight stack movement arm and a drive system in a highly compact arrangement.

SUMMARY OF PREFERRED EMBODIMENT OF THE INVENTION

In the preferred embodiment of the present invention, the biceps machine includes a movement arm rotatable about a generally horizontal axis by the user holding a movement arm and flexing the bicep muscles by pivoting the forearm at the elbow while the user is in a seated position facing the movement arm. A roller pad is mounted on a stationary support to receive the back of the user's upper arms while the back of the forearms engage a forearm pad which is secured to the movement arm to rotate therewith. Upon rotation of the movement arm, the forearm pad engages the forearms and prevents the user's body from moving forward relative to the movement arm in translation. At the same time the forearm pad in pivoting with the movement arm allows the pivot axis of the arm at the elbow to align with the pivot axis of the movement arm. By exerting the biceps the user rotates the movement arm against a resistance provided by a weight stack which is connected to the movement arm through means of a drive lever and linkage located below the weight stack and connected to the movement arm.

DRAWINGS

Other objects and advantages of the present invention will become apparent from the following more detailed description taken in conjunction with the attached drawings in which.

DETAILED DESCRIPTION

Figure 1:
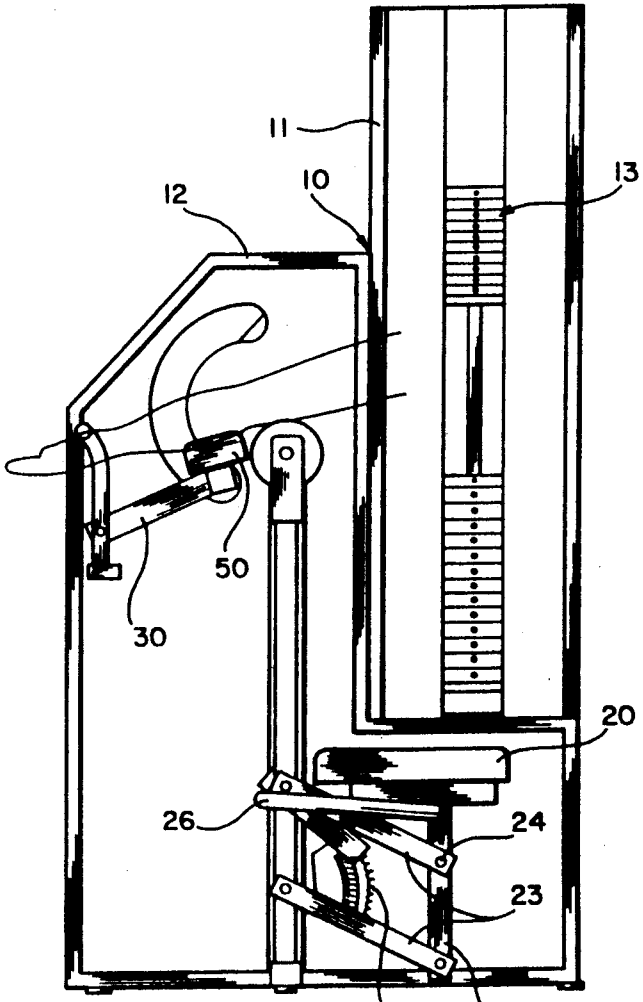
FIG. 1 is a side elevational view of a biceps curl machine constituting one preferred embodiment of the invention and shown with certain parts removed for clarity.
Figure 2:
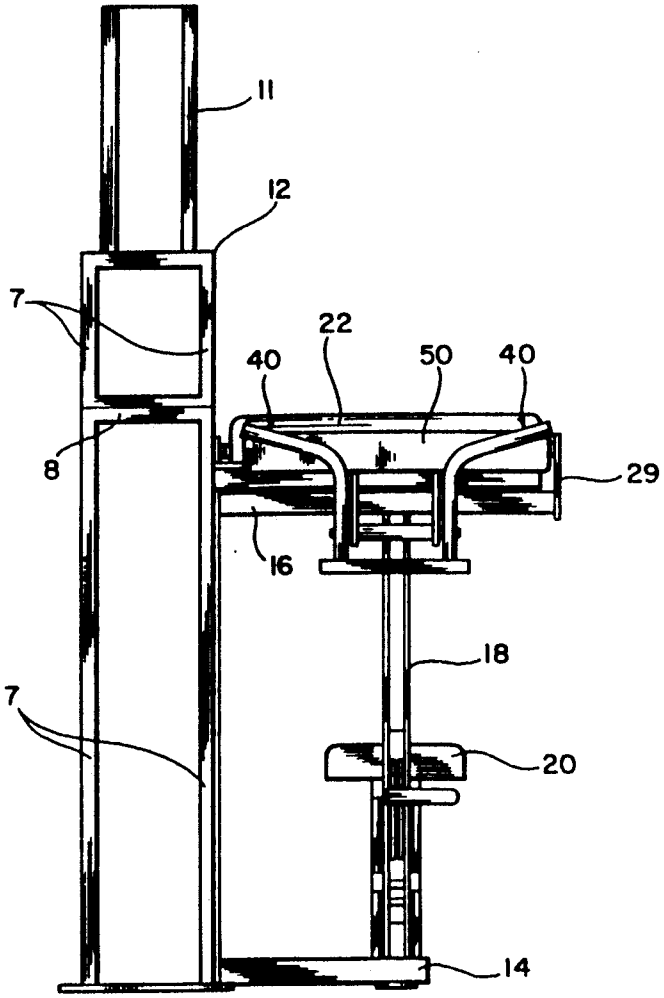
FIG. 2 is a front elevational view of the machine shown in FIG. 1.
Figure 3:
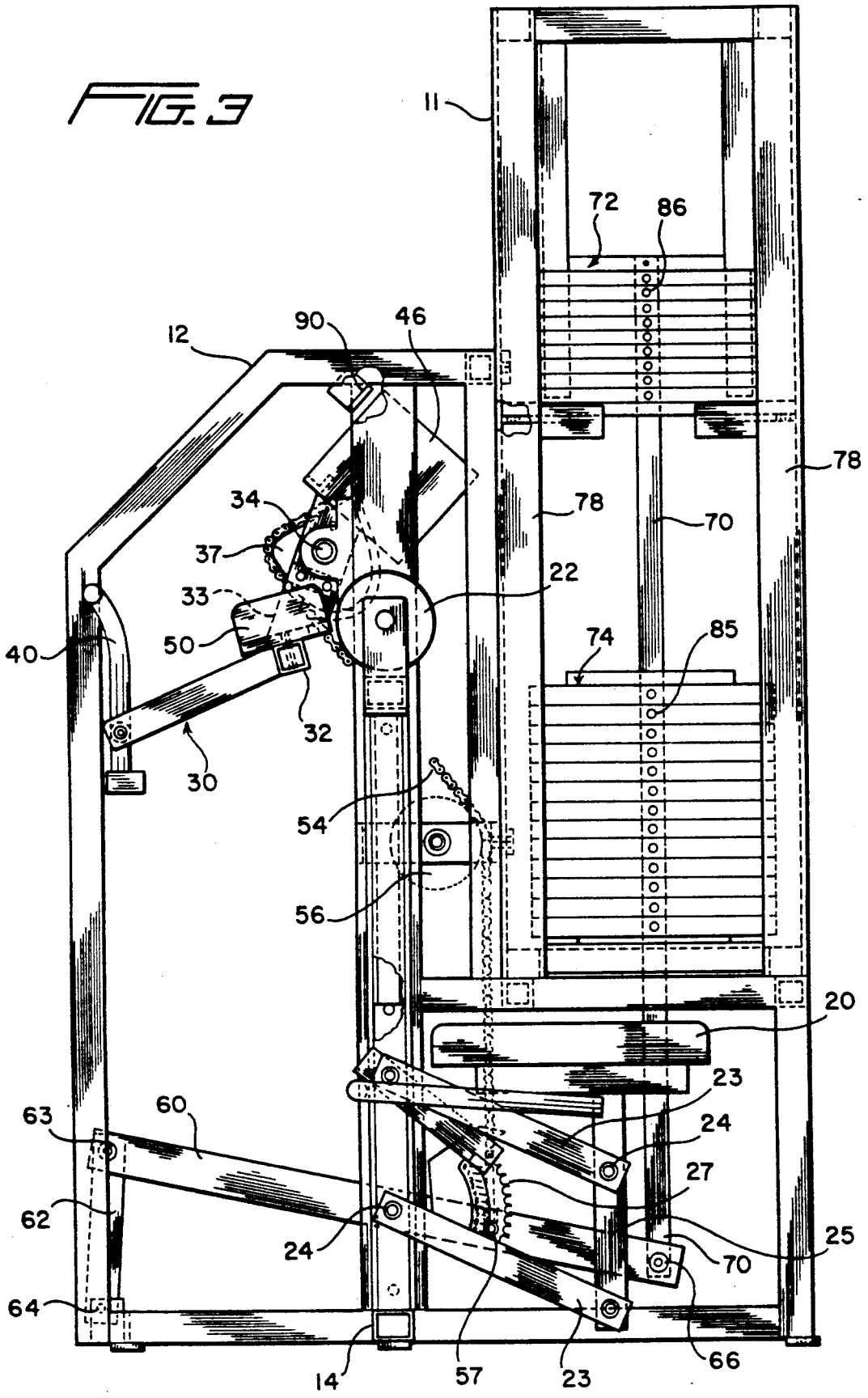
FIG. 3 is an enlarged side elevational view of the machine as seen in FIG. 1 but additionally including various parts of the drive system which interconnects a movement arm and a weight stack which provides resistance to the movement arm.
Figure 4:
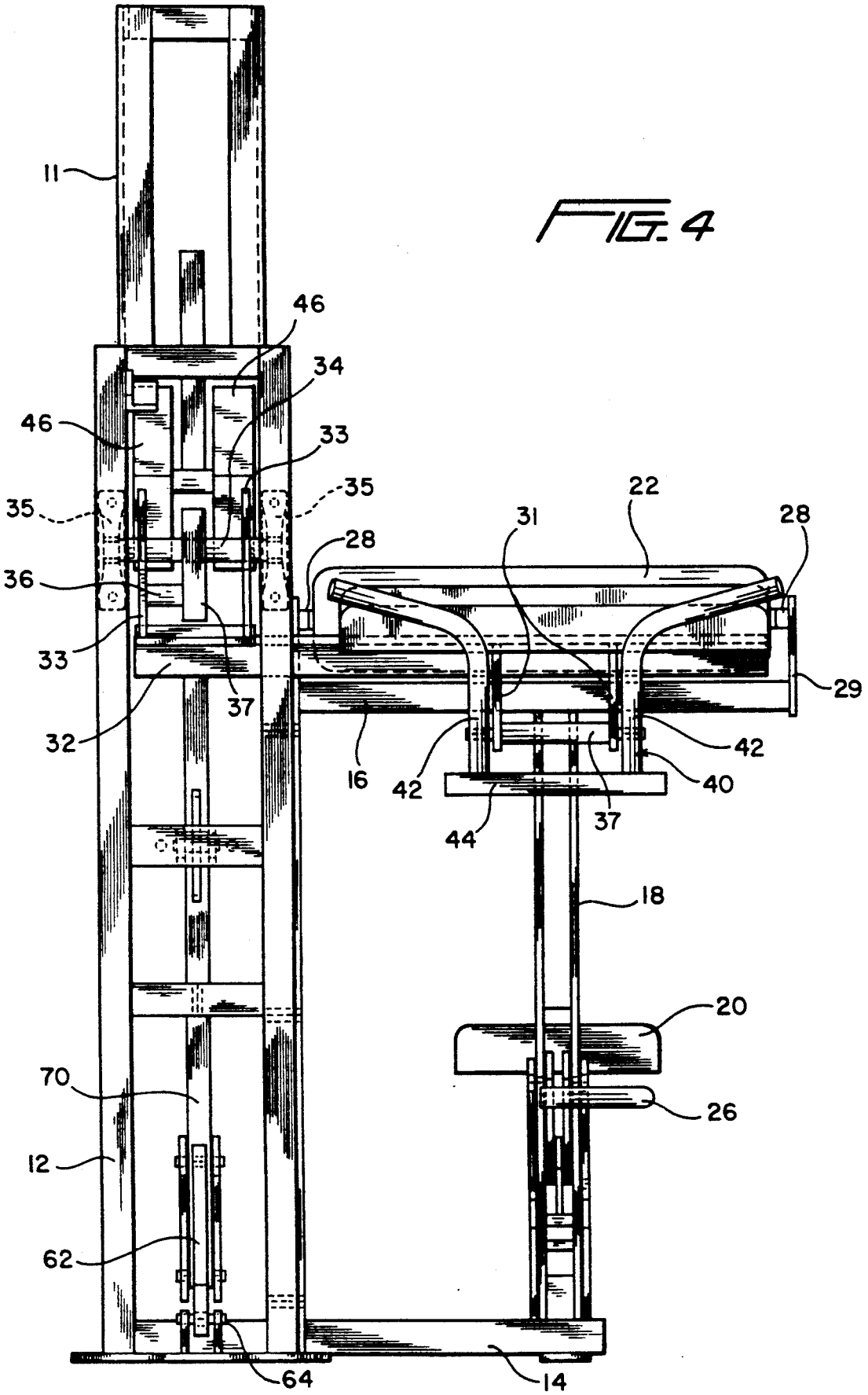
FIG. 4 is a enlarged elevational view generally similar to FIG. 2 but showing additional parts.

Referring now to the drawings in detail and initially to FIGS. 1, 2 and 3, there is shown for illustrative purposes only, an arm biceps curl machine constituting a preferred embodiment of the present invention and including a main frame generally designated 10 composed of vertical columns 7 joined by horizontal cross-pieces 8 to form a generally rectangular frame structure, the members thereof being formed from structural steel or any other suitable material of sufficient strength. Main frame 10 includes a section 11 which houses a weight stack generally designated 13. In addition, main frame 10 includes a section 12 positioned forwardly of section 11 for housing a drive system by which movement of a movement arm generally designated 30 raises one or more weights of the weight stack which serve as resistance opposing movement of the movement arm in the clockwise direction as viewed in FIG. 1. As shown in FIGS. 2 and 4, a subsidiary frame structure projects laterally from the frame 12 for purposes of supporting a horizontal seat 20 and arm support pad 22 as will be described below. The subsidiary frame includes a base 14 projecting from the foot of frame section 12, mid-height horizontal frame 16 fixed to and projecting laterally from frame 12, and a vertical frame member generally designated 18 interconnecting the subsidiary frame members 14 and 16. Seat 20 is mounted for vertical movement to adjust the level to suit the user by means of a linkage mechanism including parallel links 23 pivoted by pivots 24 at one end to the support member 25 fixed to the bottom of seat 20. In the preferred embodiment a pair of parallel links 23 are provided on opposite sides of the frame 18 for purposes of adjusting the elevation of seat 20 when actuated through any suitable handle shown at 26. Any suitable releasable latch mechanism generally designated 27 is provided for releasably holding the linkage mechanism 23 and in turn the seat 20 in a desired adjusted position.

Supported on a subsidiary frame member 16 to extend laterally of the main frame sections 11 and 12 is a pad for supporting the upper arm portions of the user as best shown in FIG. 1. The preferred embodiment of this pad is a roller pad 22 having shafts 28 in the opposite ends thereof mounted in plates 29 fixed to frame member 16 as best shown in FIG. 4. Roller pad 22 is rotatable relative to the frame 16.

Figure 5:
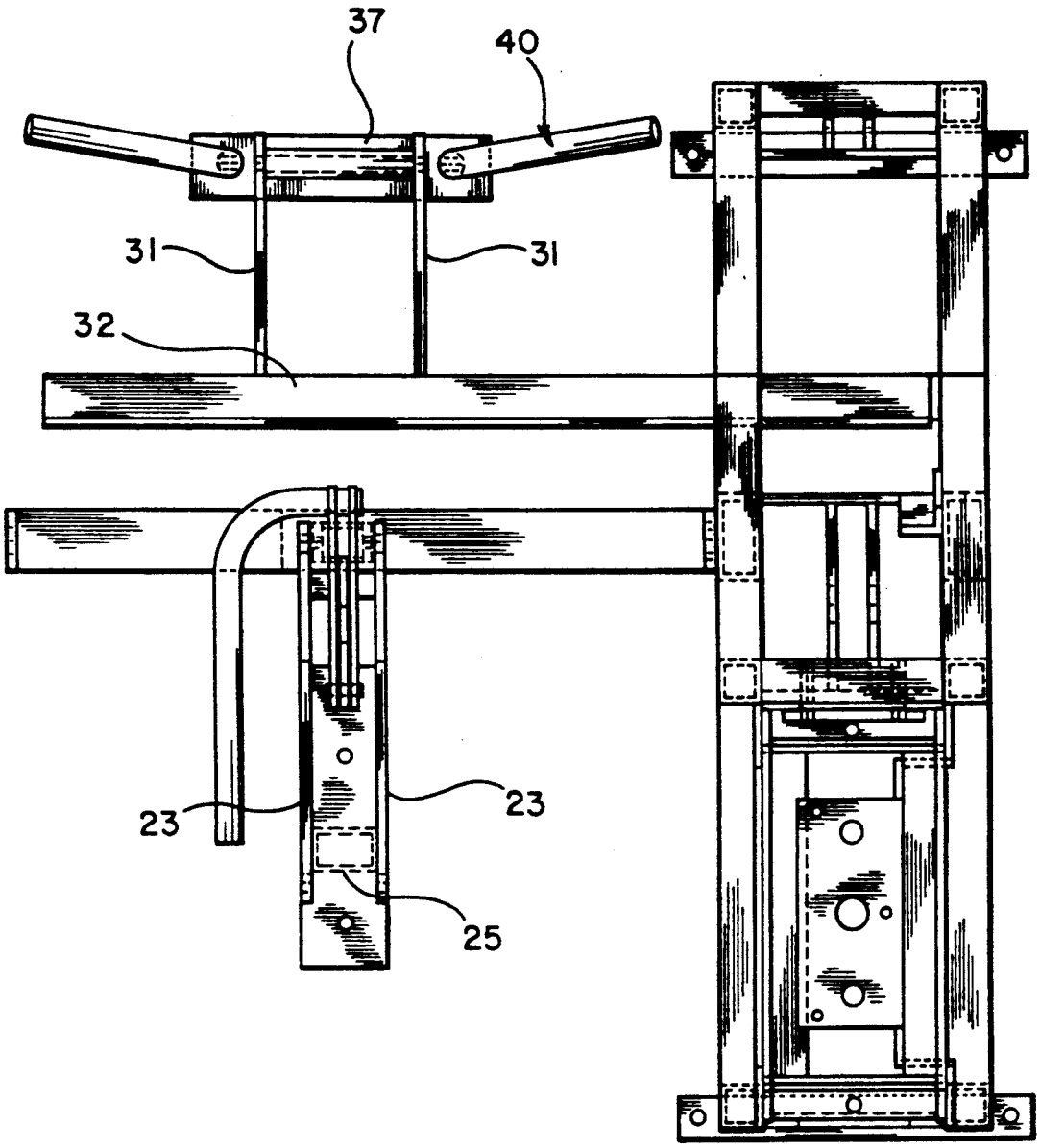
FIG. 5 is a plan view of the machine with certain parts removed for clarity.

Referring to FIGS. 4 and 5, movement arm 30 includes in the preferred embodiment an elongated beam 32 mounted for movement about a shaft 34 (FIG. 4) by means of a yoke fixed to the beam 32 and having arms 33 rotatably mounted on shaft 34. The latter in turn is mounted on frame 12 by bearings 35. For rotating the movement arm about shaft 34, a hand grip 40 is connected to the movement arm beam 32 by means of connecting members 31 fixed to beam 32 at one end and pivotally connected to the hand grip 40 at the other end by means including a cross piece 37. In the preferred embodiment hand grip 40 includes opposed inverted L-shaped members as seen in FIG. 4 interconnected at their lower end by a crosspiece 44 and pivotally connected intermediate their ends to members 31 as described above. Hand grip 40 is adjustable relative to movement cam 30 to suit the size of the user's forearms. Crosspiece 40 is suitably weighted to balance the hand grip 40.

Figure 6:
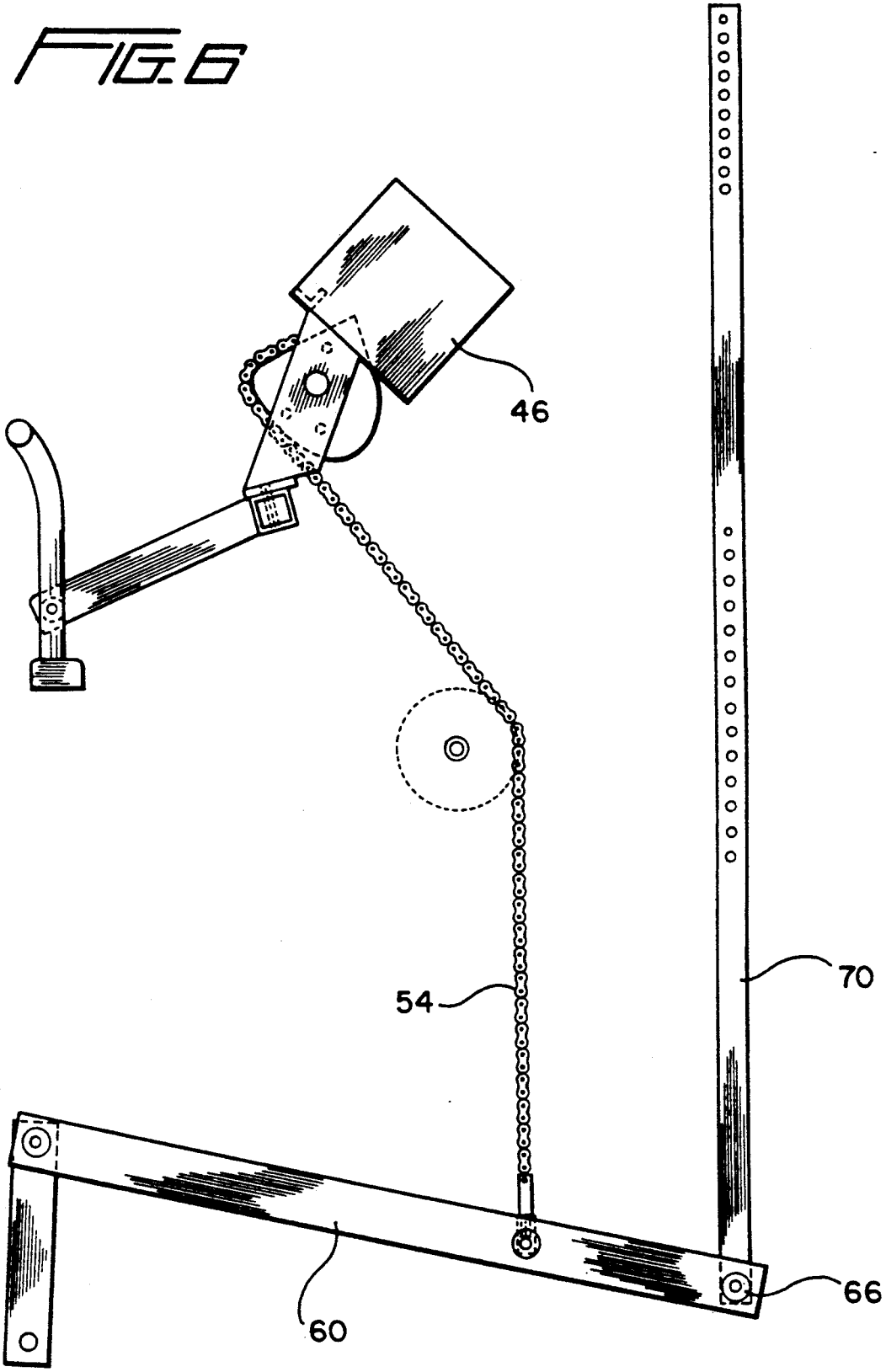
FIG. 6 is a side elevational view of the movement arm and drive system when the movement arm is at a start position.
Figure 7:
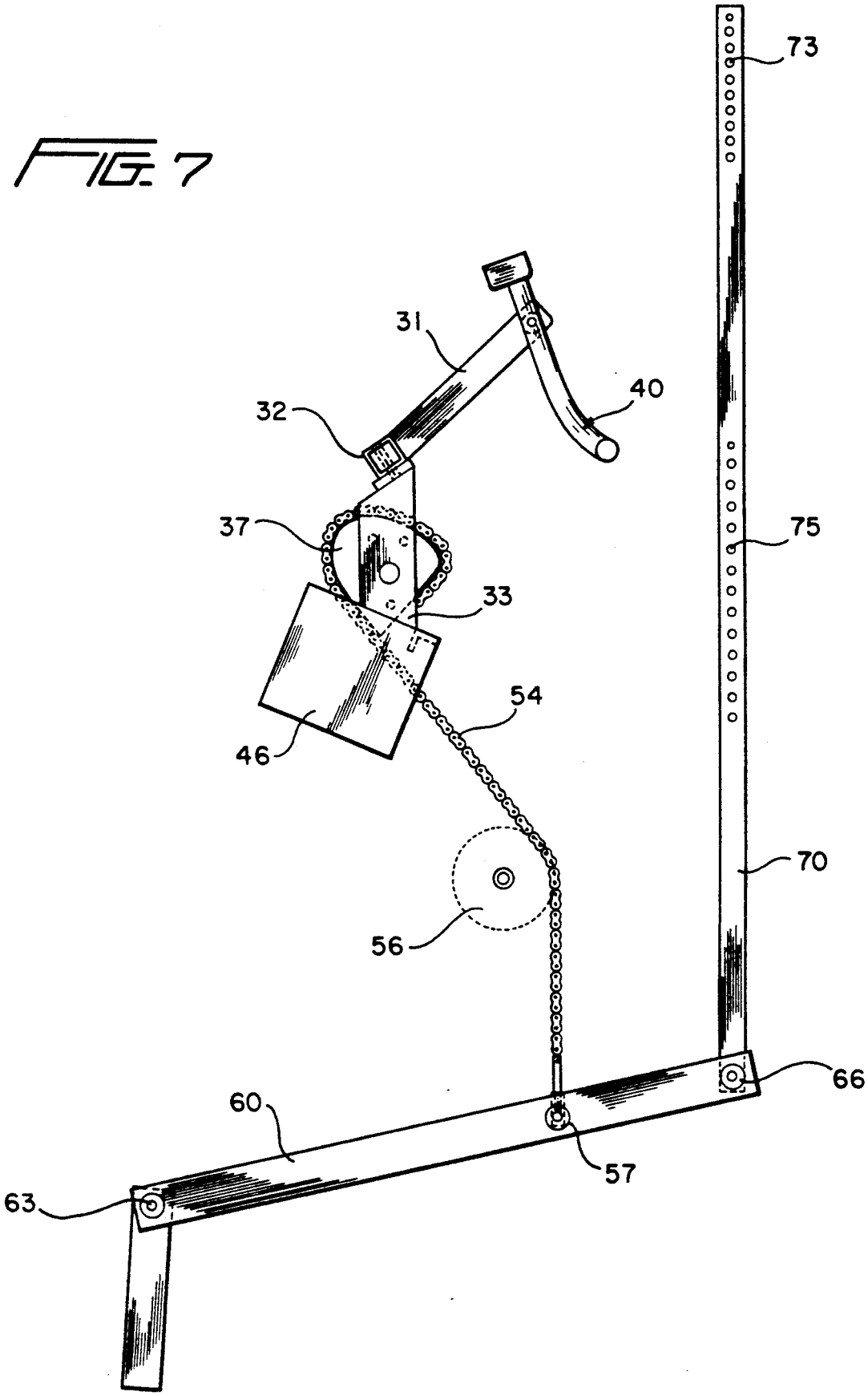
FIG. 7 is a view generally similar to FIG. 6 but showing the parts when the movement arm is at a finish position.

Rotation of movement arm 30 about movement arm shaft 34 is transmitted by a connecting member 36 to a cam 37 mounted for rotation about shaft 34 as shown in FIGS. 3 and 4. Cam 37 is connected to the resistance weight which imposes a force in opposition to rotation of the movement arm 30 about shaft 34 in a clockwise direction as shown in FIGS. 3, 6 and 7. In the preferred embodiment this connection is through means of a chain 54 fixed at one end to the periphery of the cam 37 and trained for a portion of its length around cam 37. In addition and as seen in FIG. 3 chain 54 is trained about an idler pulley 56 supported in arms fixed to frame portion 18. At its lower end, chain 54 is pivoted at 57 to an intermediate portion of a drive lever 60 the forward end of which is pivoted at 63 to a vertical link 62 whose bottom end is pivoted at 64 to the base of frame 12. The opposite end of drive lever 60 is pivotally connected by pivot 66 to the lower end of a weight stack rod or pin generally designated 70 extending vertically in frame section 11. When the movement arm is pivoted clockwise from the position shown in FIG. 6 to that of FIG. 7, the chain 54 lifts lever 60 about pivot 63 causing rod 70 to lift one or more reistance weights. In the preferred embodiment a compound weight stack such as shown in my U.S. Pat. No. 4,834,365 is employed including an upper stack 72 and a lower stack 74 of individual weights in the form of plates guided in vertical movement by frame members 78 shown in FIG. 3. One or more of the weights in stacks 72 and/or 74 may be connected to pin 70 by inserting a pin through apertures 85 or 86 in the weight plates and in apertures 75 and 73 (FIG. 7) in the weight stack rod 70. As will be understood, one or more weights of either stack 72 or 74 may be connected to the pin 70. Also if desired, one or more weight plates of only one of these stacks 72 or 74 may be connected to pin 70. In one embodiment, the weight plates of the upper stack 72 may be each two pounds thus allowing weight changes in two pound increments. Of course any other suitable weight plates may be chosen for the upper or lower stacks 72 and 74. Because of the orientation of the weight stack relative to the seat 20, the user may change the resistance weight while seated on seat 20.

Figure 9:
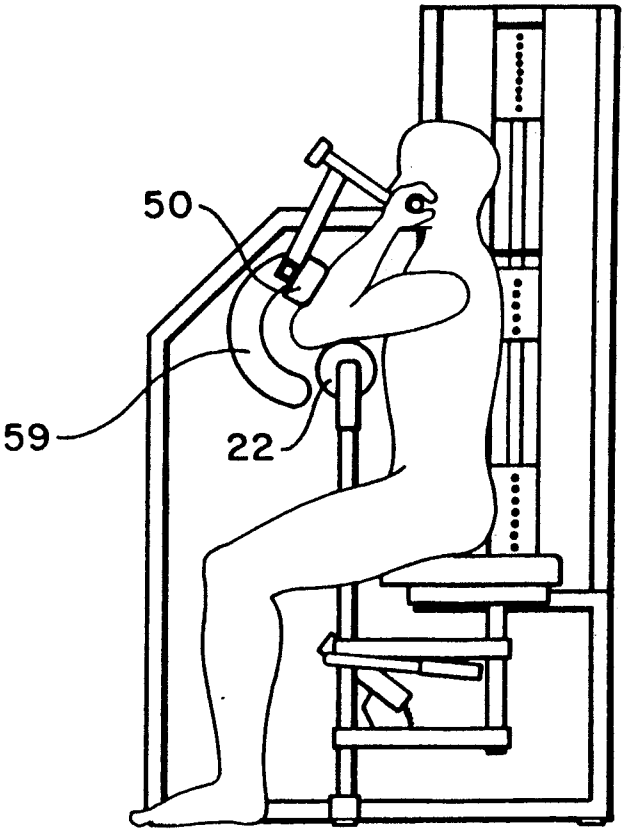
FIGS. 8 and 9 are schematic views showing a user of the machine at start and finish positions corresponding to FIGS. 6 and 7.
Figure 8:
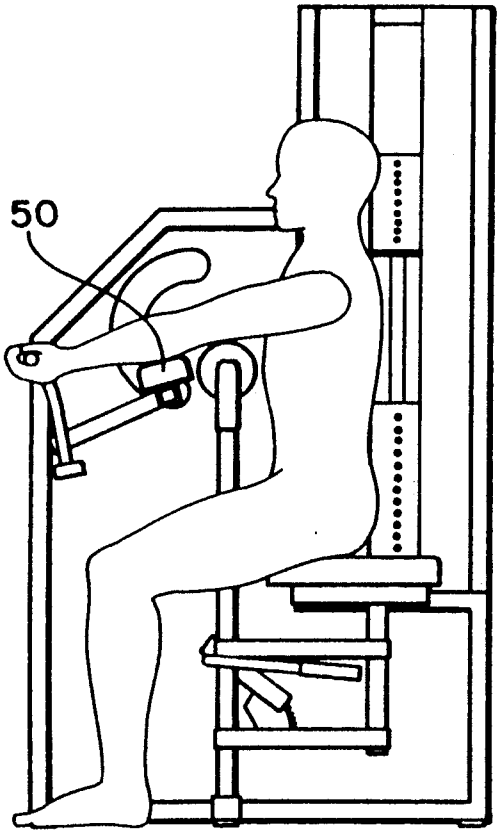

In use of the machine, the user sits on seat 20 with his legs straddling the vertical frame 18. In the starting position shown in FIGS. 1 and 8, the user extends his arms so that the backs of the upper arm portions rest on the roller pad 22 and so that the hands are free to grip the hand grip 40 of the movement arm. Assuming the position of seat 20 and the desired weight resistance has been selected, the user pivots his forearms about the elbow while rotating the movement arm about the movement arm shaft 34 which of course requires that the biceps be flexed. In order to prevent the user's torso from moving forwardly relative to the seat 20 as he performs the exercise, a forearm pad generally designated 50 is provided on the movement arm to extend along the beam 32 as best shown in FIGS. 3 and 4. Pad 50 is fixed to the beam 32 to be rotatable therewith along the arc 59 (FIG. 9) and about the pivot axis 34 of the movement arm. In this way the forearm pad 50 moves forwardly and upwardly in rotation about the movement arm shaft 34 with the backs of the forearms pressed against the pad 50 as the user exerts his bicep muscles to lift the resistance weights. Note from FIG. 9 how the user is constrained by pads 50 and 22. Moreover because of the rotation of pad 50 as the user bends his elbow and lifts the resistance weight, the position of the elbow is allowed to self-adjust to generally align itself with the pivot axis 34 of the movement arm thus achieving efficient operation. FIGS. 8 and 9 illustrate the positions of the forearm pad at the beginning and end of the weightlifting stroke. At the end of the stroke the resistance weight is lowered by extending the forearms to the start position of FIG. 8. The exercise is then repeated as desired.

In the preferred embodiment the movement arm 30 is balanced about the shaft 34 by means of counterweights 46 respectively fixed to members 33 as shown in FIGS. 3 and 4. If desired a stop 90 may be provided in frame 12 to engage counterweight 46 to limit its movement.

It will be seen that the present invention provides a compact and efficient machine which eliminates overhead pulley and cables to weight stack thereby reducing friction losses. Moreover the invention avoids discomfort of pads which press against the chest in conventional biceps curl machines as the user rotates the movement arm and the body moves forwardly against a fixed pad. At the same time the present invention allows the arms to adjust to comfortably position them with the elbows generally aligned with the pivot axis of the movement arm. This increases efficiency of the exercise.

What is claimed is:

1. A machine for exercising the biceps of the arms, comprising in combination, a movement arm movable about a generally horizontal axis having means extending upwardly from a plane of the movement arm to be gripped by a user above said plane for pivoting the movement arm about said axis, a first pad at a fixed location to be engaged by the user's arms above the elbows when gripping said means to support the user's arms above the elbows in a generally horizontal plane against downward movement, a second pad located forwardly of said first pad and being mounted on said movement arm to engage the backsides of forearms of the user while the user is gripping said means with the user's elbows positioned between said pads and in general alignment with said axis, said second pad being movable with the movement arm about said axis to provide an unsupported space between the first and second pads for receiving the elbows of the arms and wherein the second pad is movable between a first position located adjacent and forwardly of the first pad and a second position raised above the first position and spaced from the first pad and wherein there is further included a seat located rearwardly of and below said first pad for receiving the user in seated position.

2. The machine defined in claim 1 further including a weight stack including a vertical rod connectable to one or more weights in the weight stack, and a lever located below the level of the weight stack and connected to the rod and also to the movement arm for lifting the rod when the movement arm is rotated about said axis in one direction and means including a pivot connecting the lever and the rod.

3. The machine defined in claim 2 wherein the weight stack includes a first and second stacks of weights each including weights which are independently connectable to the rod such that weights from one or the other or both of the weight stacks may be connected to the rod.

4. The machine defined in claim 2 wherein the weight stack is located adjacent to one side of the seat within the reach of the user while seated on said seat.

5. The machine defined in claim 2 wherein the weight stack includes a first and second stacks of weights each including weights which are independently connectable to the rod such that weights from one or the other or both of the weight stacks may be connected to the rod.

6. The machine defined in claim 2 including a link pivotally connected to the lever, a chain or cable connected at one end to the movement arm and at the other end to the lever at a location intermediate the link and the rod, said link being pivotally connected to a base structure.

7. The machine defined in claim 1 further including a shaft defining said horizontal axis of the movement arm, a support frame, said shaft being mounted in said support frame, said movement arm including an elongated member mounted for rotation about said shaft and projecting from one side of the frame, said second pad being mounted on said elongated member, a connecting member extending forwardly of the elongated member and wherein said means to be gripped is pivotally mounted to said connecting member.

8. The machine defined in claim 7 wherein said frame is located forwardly of a weight stack connected to the movement arm to provide resistance to movement of the movement arm in one direction.

9. The machine defined in claim 8 wherein said seat is located adjacent to and laterally of the weight stack.

10. The machine defined in claim 7 including a counterweight fired to the movement arm on a side of the shaft opposite said means.

11. The machine defined in claim 1 wherein said means to be gripped by a user is included in a member pivotally mounted to said movement arm and including a portion extending below the plane of the movement arm and having a counterweight for balancing said member.

12. The machine defined in claim 11 wherein there is further included a second counterweight for balancing the movement arm about said axis.

* * * * *